US010844649B1

(12) United States Patent
Moffitt

(10) Patent No.: US 10,844,649 B1
(45) Date of Patent: Nov. 24, 2020

(54) SILL PAN CONCEALMENT SYSTEM AND METHOD FOR CONCEALING A SILL PAN WALL ACROSS A THRESHOLD

(71) Applicant: JAMSILL, INC., Talent, OR (US)

(72) Inventor: Gregory A. Moffitt, Talent, OR (US)

(73) Assignee: JAMSILL, INC., Talent, OR (US)

( * ) Notice: Subject to any disclaimer, the term of this patent is extended or adjusted under 35 U.S.C. 154(b) by 126 days.

(21) Appl. No.: 16/141,798

(22) Filed: Sep. 25, 2018

Related U.S. Application Data

(60) Provisional application No. 62/714,718, filed on Aug. 5, 2018.

(51) Int. Cl.
*E06B 1/70* (2006.01)

(52) U.S. Cl.
CPC ..... *E06B 1/70* (2013.01)

(58) Field of Classification Search
CPC ..... E06B 1/70
See application file for complete search history.

(56) References Cited

U.S. PATENT DOCUMENTS 4,055,917 A * 11/1977 Coller ..... E06B 1/70 49/469
4,716,683 A 1/1988 Minter
4,831,779 A * 5/1989 Kehrli ..... E06B 1/70 49/380
5,067,279 A * 11/1991 Hagemeyer ..... E06B 1/70 49/470
6,052,949 A 4/2000 Procton et al.
6,484,446 B2 11/2002 Young
7,222,462 B2 5/2007 Ellingson
7,669,369 B2 * 3/2010 Henry ..... E06B 1/70 49/408
8,061,086 B2 11/2011 Haun
8,375,658 B2 2/2013 Ryan et al.
8,695,293 B2 * 4/2014 Teodorovich ..... E06B 1/702 49/471
9,725,945 B2 8/2017 Swank et al.
9,845,634 B2 12/2017 Heid et al.
10,100,570 B1 * 10/2018 Ortega ..... E06B 1/70
10,370,891 B2 * 8/2019 Farahmandpour ..... E06B 7/14
10,400,502 B2 * 9/2019 Vos ..... E06B 1/64
2006/0174545 A1 8/2006 Young
2009/0165406 A1 * 7/2009 Campbell ..... E06B 1/70 52/211
2017/0298677 A1 10/2017 Swank et al.

* cited by examiner

*Primary Examiner* — Catherine A Kelly
(74) *Attorney, Agent, or Firm* — Jerry Haynes Law

(57) ABSTRACT

A sill pan concealment system and method for concealing a sill pan wall that lies across a threshold. The system comprises a sill pan that rests flush across the threshold, and a sill that is disposed parallel and in alignment with the sill pan. The sill fits into the sill pan to create a protruding barrier across the threshold. The sill pan has an interior wall oriented towards the interior region; and an exterior wall oriented towards the exterior region. The sill has a sill interior end that orients towards the sill an interior wall. The sill interior end forms an elongated notch through a cross section of the sill. The notch is sized and dimensioned to align with, and receive the interior wall of the sill pan. In this manner, the interior wall of the sill pan is concealed in the notch, from the perspective of interior region.

19 Claims, 4 Drawing Sheets

SILL PAN CONCEALMENT SYSTEM AND METHOD FOR CONCEALING A SILL PAN WALL ACROSS A THRESHOLD

CROSS-REFERENCE TO RELATED APPLICATIONS

This application claims the benefits of U.S. provisional application No. 62/714,718, filed Aug. 5, 2018 and entitled THRESHOLD ASSEMBLY AND METHOD FOR CONCEALING A SILL PAN EDGE ACROSS A THRESHOLD, which provisional application is incorporated by reference herein in its entirety.

FIELD OF THE INVENTION

The present invention relates generally to a sill pan concealment system and method for concealing a sill pan edge across a threshold. More so, the present invention relates to a sill pan concealment system and method of concealing the interior edge of a sill pan by providing a sill that rests on the sill pan, across the threshold; forming a notch in a sill interior end of the sill; and aligning the interior edge of the sill pan to the notch in the sill interior end; and concealing the sill pan interior edge in the notch, from the perspective view of the threshold.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, a threshold is a sill, or entryway of a door or window. The threshold also provides a decorative barrier that separates both sides of the doorway. A threshold assembly is often a sill pan and an overlaying sill that protrudes above the floor across the threshold. Typically, the entire threshold assembly, including door jambs, door, sidelight frames, and sidelights are built upon a heavy wooden base plate. In these cases, a fixed panel rests directly on a base plate, or sill pan, and are sealed in sidelight frames that are formed by the jambs of the threshold assembly.

It is known in the art that an exterior door is often exposed to wind-blown rain or splashback; and thereby the door jambs can get wet. When water dribbles down the jambs, it often finds a crack between the jamb and the threshold, soaking the subfloor under the door. Eventually, a rotting subfloor and a rotting rim joist is created. Thus, a sill pan helps seal the threshold from moisture, wind, and debris.

Often in the threshold assembly, one end of the sill and a correlating end of the sill pan are parallel, and vertically oriented in relation to the subfloor. Consequently, the interior edge of the sill pan is often visible from the threshold. This can cause an unsightly protrusion across the threshold.

Other proposals have involved sills and sill pans that position across a threshold. The problem with these threshold assemblies is that they do not cover the unsightly edges and flanges that extend from the sill pan. Even though the above cited threshold assemblies meet some of the needs of the market, a sill pan concealment system and method of concealing the interior edge of a sill pan by providing a sill that rest on the sill pan, across the threshold; forming a notch in a sill interior end of the sill; and aligning the interior edge of the sill pan to the notch, and concealed from the view point of the threshold, is still desired.

SUMMARY

Illustrative embodiments of the disclosure are generally directed to a sill pan concealment system and method for concealing a sill pan edge across a threshold. The sill pan concealment system is operable across a threshold that separates an interior region and an exterior region of a room, chamber, or region. The sill pan concealment system provides both a sill pan and a sill that fastens in the sill pan, with the sill having a notch that conceals the interior edge, or other unsightly flanges, perimeter areas, of the sill pan.

In some embodiments, the sill pan concealment system comprises a sill pan that rests flush across a subfloor across a threshold, and a sill that is disposed parallel and in alignment with the sill pan. The sill pan has a pan base panel terminating at a pan interior edge that is oriented towards the interior region, and a pan exterior edge oriented towards the exterior region. The edges are oriented in different directions.

In some embodiments, the sill pan concealment system comprises a sill that rests on the sill pan, extending parallel and flush against the sill pan. The sill fits into the sill pan to create a protruding barrier across the threshold. The sill has a sill base surface that forms a sill upper surface, facing away from the subfloor on which the sill pan rests. The sill also has a sill interior end that orients towards the pan interior edge, and a sill exterior end that orients towards the pan exterior edge. The sill interior end forms an elongated notch through a cross section of the sill. The notch is sized and dimensioned to align with, and receive the interior edge of the sill pan. In this manner, the interior edge of the sill pan is concealed in the notch, from the perspective of the interior region. In one alternative embodiment, a pre-fabricated molded plastic sill pan system is also provided.

In another aspect, the pan exterior edge and the pan interior edge orient in opposite directions.

In another aspect, the sill upper surface is tapered.

In another aspect, the pan base panel of the sill pan rests flush against a subfloor.

In another aspect, the sill pan and the sill are disposed across a threshold, the threshold separating an exterior region and an interior region.

In another aspect, the sill exterior end is oriented towards the exterior region.

In another aspect, the sill interior end is oriented towards the interior region.

In another aspect, the notch faces towards the interior region.

In another aspect, the notch is vertically oriented in relation to a door.

In another aspect, the notch forms through a cross section of the sill interior end.

In another aspect, the notch is elongated.

In another aspect, the notch is at least ¼" wide.

In some embodiments, the present invention provides a method for concealing the interior edge of the sill pan. In one possible embodiment, the method includes an initial step of providing a sill pan, the sill pan defined by a pan base panel terminating at a pan exterior edge and a pan interior edge.

The method further comprises a step of mounting the sill pan to a subfloor, such that the sill pan is oriented to extend across a threshold.

Another step comprises providing a sill, the sill defined by a sill base surface, a sill upper surface, a sill exterior end, and a sill interior end sized and dimensioned to position parallel, and in alignment with the sill pan, whereby the sill interior end orients towards the pan interior edge.

Yet another step may include forming an elongated notch across the sill interior end.

In some embodiments, a step comprises aligning the pan interior edge with the sill interior end.

A step includes fitting the pan interior edge into the notch, such that the pan interior edge is at least partially concealed beneath the sill interior end.

A final step comprises fastening the sill to the sill pan.

One objective of the present invention is to conceal the unsightly edge of the sill pan along the threshold.

Another objective is to utilize the sill pan concealment system and method for both door and window thresholds.

Yet another objective is to form the notch in the sill, such that various types, sizes, and shapes of sill pans can have their edges concealed.

Yet another objective is to form a notch at least ¼" wide.

Yet another objective is to orient the notch vertically in relation to a door.

Yet another objective is to face the notch towards the interior of the threshold.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
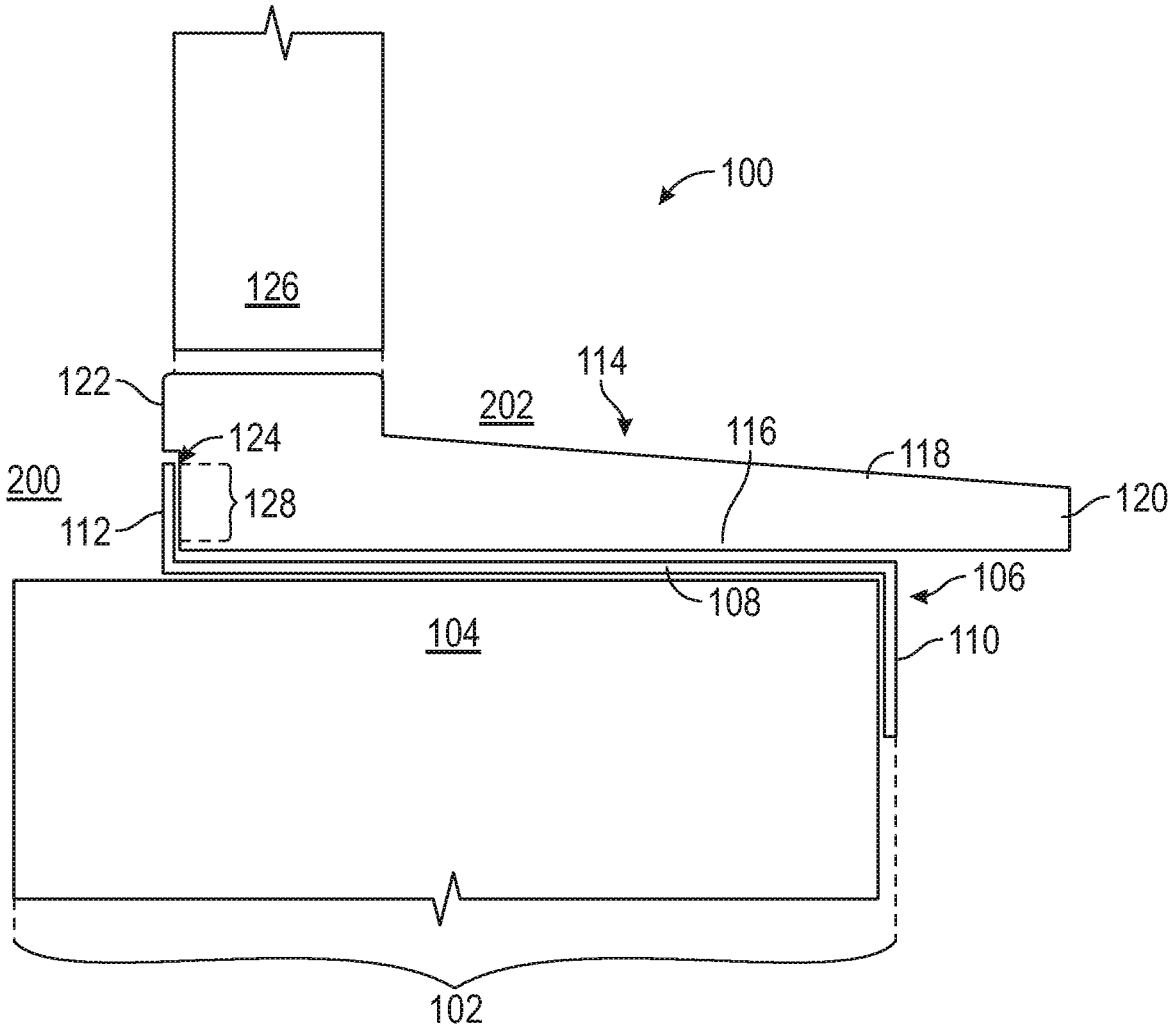
FIG. 1 illustrates an elevated side view of an exemplary sill pan concealment system for concealing a sill pan edge across a threshold, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A sill pan concealment system 100 and method 300 for concealing a sill pan edge across a threshold is referenced in FIGS. 1-4. The sill pan concealment system 100, hereafter "system 100" is operable across a threshold 102 that separates an interior region 200 and an exterior region 202 of a room, chamber, or region. As referenced in FIG. 1, the system 100 provides both a sill pan 106 and a sill that fastens on the sill pan 106, with the sill 114 having a notch 124 that receives; and thereby conceals the interior edge 112 of the sill pan 106.

In some embodiments, the system 100 comprises a sill pan 106 that rests flush across a threshold 102. The system also comprises a correlating sill 114 that is disposed parallel and in alignment with the sill pan 106. The sill 114 fastens to the sill pan 106; though in some embodiments, the sill 114 and sill pan 106 may be integral. The sill pan 106 and the sill 114 are configured to extend across a threshold 102 that separates an interior region 200 from an exterior region 202 of a room, chamber, or enclosed area. In some embodiments, the threshold 102 may include, without limitation, a doorway, a window frame, and a patio sliding door.

Figure 2:
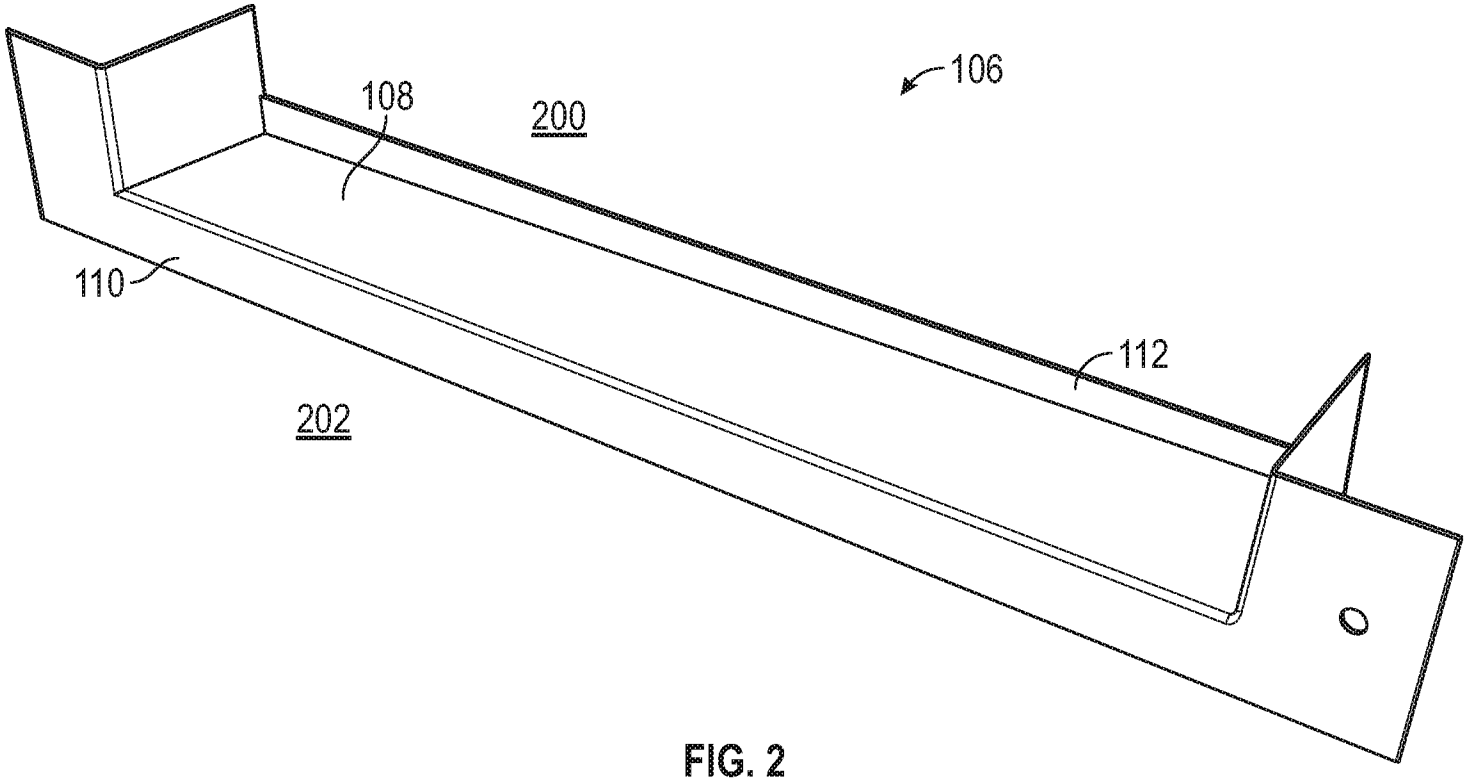
FIG. 2 illustrates a perspective view of an exemplary sill pan, in accordance with an embodiment of the present invention.

As FIG. 2 illustrates, the sill pan 106 comprises a pan base panel 108 that rests flush against a subfloor. The pan base panel 108 lies parallel to a subfloor 104, while extended across a threshold of a doorway 126 or window opening. The pan base panel 108 is sized and dimensioned to substantially cover the width and length of the threshold 102. The sill pan 106 is scalable to accommodate variously sized and dimensioned thresholds known in the art. In some embodiments, the pan base panel 108 may form apertures to enable passage of fasteners, such as screws or bolts that securely fasten the sill pan 106 to the subfloor 104.

The pan base panel 108 is defined by a pan exterior edge 110 that orients towards the exterior region 202. The sill pan 106 may also include a pan interior edge 112 that orients towards the interior region 200. The pan exterior and interior edges extend perpendicularly from opposite ends of the pan base panel 108. In one non-limiting embodiment, the pan exterior edge 110 and the pan interior edge 112 orient in opposite directions. Though in some configurations of a sill pan 106, the pan edges 110, 112 orient in the same direction. The pan edges 110, 112 may be slightly elongated, forming a flange that protrudes from the pan base panel 108.

In some embodiments, such as where the threshold is indoors, the pan exterior and interior edges 110, 112 may be arbitrarily oriented. It is an objective of the present invention to at least partially conceal the pan exterior edge 110 or the pan interior edge 112. In one non-limiting embodiment, the pan interior edge 112 is concealed, while the pan exterior edge 110 is visible.

Looking back at FIG. 1, the system 100 further comprises a sill 114 that rests on the sill pan 106, extending parallel and flush against the sill pan 106. The sill 114 fits into the sill pan 106 to create a protruding barrier across the threshold, with the sill pan 106 enhancing the aesthetics of the sill, and providing a stable foundation on the subfloor 104. The sill 114 has a sill base surface 116 that forms a sill upper surface 118, which in some embodiments, is tapered. The sill base surface 116 faces away from the subfloor on which the sill pan 106 rests. In one embodiment, the sill 114 is at least 1" thick and 6" long. Though other dimensions may be used.

In some embodiments, the sill 114 is the dividing piece of wood or stone located in the bottom of a doorway or window opening. The sill 114 is configured to lie parallel to a subfloor, while extended across a threshold of a doorway 126 or window opening. The sill 114 helps prevent moisture, debris, or pests from passing beneath a door or window through the threshold. As discussed above, the sill pan 106 forms a stable, raised foundation for support of the sill. The sill pan 106 also conceals the edges of the sill 114, so as to enhance appearance of the sill.

Looking again at FIG. 1, the sill 114 also has a sill interior end 122 that orients towards the pan interior edge 112, and also orients to the interior region. The sill 114 also has a sill exterior end 120 that orients towards the pan exterior edge 110, and also orients towards the exterior region. In one embodiment, the sill interior end 122 aligns with the pan interior edge 112 when the sill rests in the sill pan 106. In this arrangement, the sill interior end 122 and the pan interior edge 112 are parallel, and vertically oriented in relation to the subfloor 104. Consequently, the pan interior edge 112 is visible from the interior region 200 of the threshold 102. Those skilled in the art will recognize that this creates an unsightly protrusion across the threshold 102.

The sill interior end 122 forms a notch 124. The notch 124 is cut out in an elongated shape and forms through a cross section of the sill interior end 122 of the sill. In some embodiments, the notch 124 is formed in the sill interior end 122, i.e. lower corner, of the sill. The notch extends from the sill base surface 116, upwardly towards the sill upper surface 118 of the sill. Because the notch is on the interior end, the notch 124 faces towards the interior region. The notch may be cut, drilled, or chopped off the interior edge of the sill 114.

The notch 124 is defined by a notch inner surface 128 that mates with the interior edge of the sill pan 106. The notch 124 is sized and dimensioned to align with, and receive the interior edge of the sill pan 106. In this manner, the notch inner surface and the pan interior edge 112 at least partially engage. Consequently, the interior edge of the sill pan 106 is concealed in the notch 124, from the perspective of the interior region 200. In one non-limiting embodiment, the notch 124 is at least ¼" wide.

However in an alternative embodiment, the notch 124 is formed in the sill exterior end 120 of the sill 114, so as to receive, and thereby conceal the pan exterior edge of the sill pan 106. In yet another alternative embodiment, two notches are formed—one in the sill exterior end, and one in the sill interior end of the sill. In any case, at least one of the edges of the sill pan 106 are concealed in the notch that forms in the sill 114.

Figure 4:
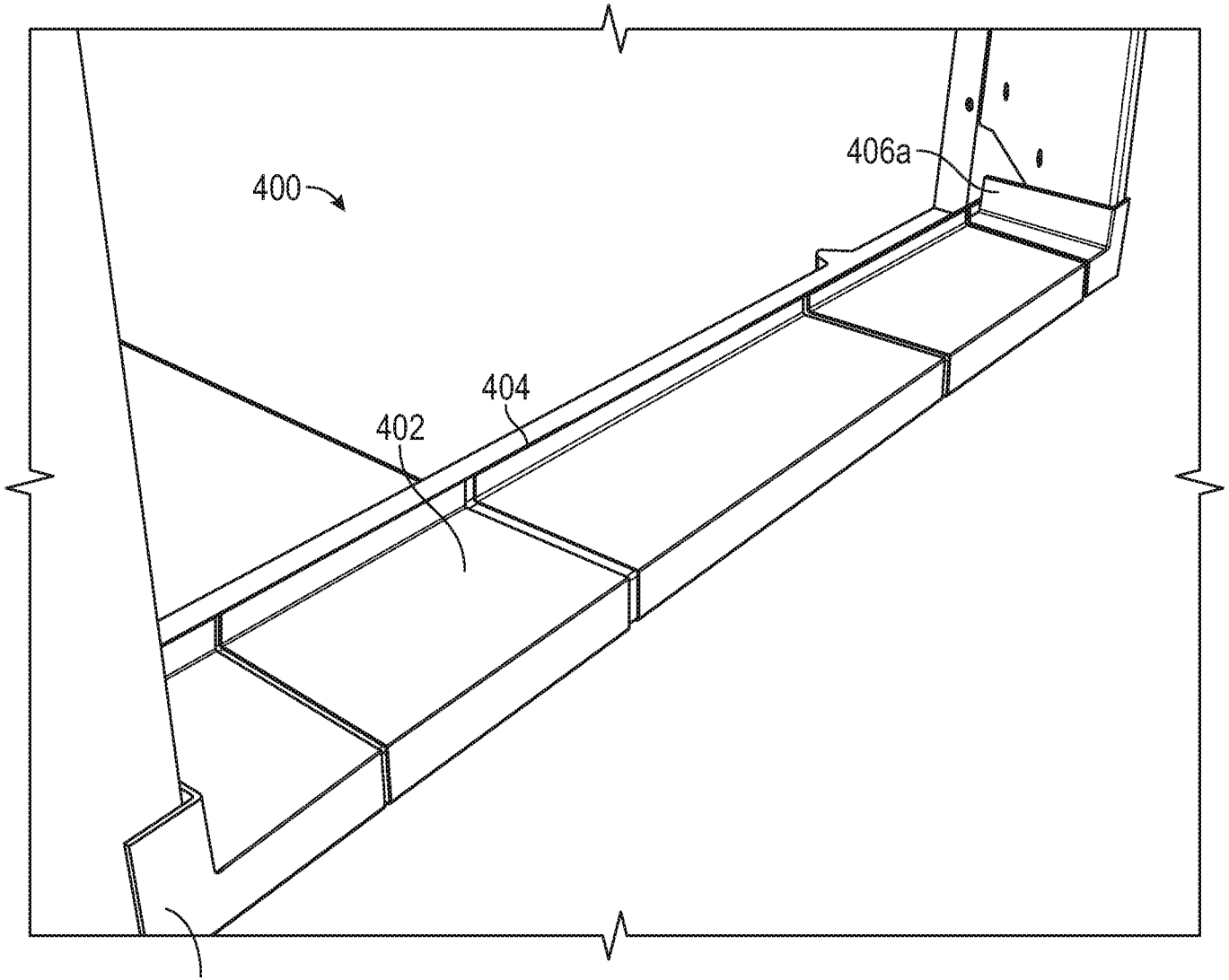
FIG. 4 illustrates a perspective view of an exemplary pre-fabricated molded plastic sill pan system, in accordance with an embodiment of the present invention.

In one alternative embodiment shown in FIG. 4, a pre-fabricated molded plastic sill pan system 400 is also provided. The pre-fabricated molded plastic sill pan system 400 provides an integral sill 402 and sill pan 404; constructed primarily of a durable, plastic material. In this embodiment, the sill 402 and the sill pan 404 are integral, and custom sized to fit across a threshold. A pair of flanged ends 406*a*, 406*b* also rest flush against the door or window frame to enhance aesthetics. And similar to the above-mentioned system 100, a pan interior edge of the sill pan 400 is at least partially concealed inside a notch that forms in the sill 402. In this manner, the sill and sill pan do not have to be mated together, but rather form an attractive one-piece system 400 that facilitates mounting across the threshold.

Figure 3:
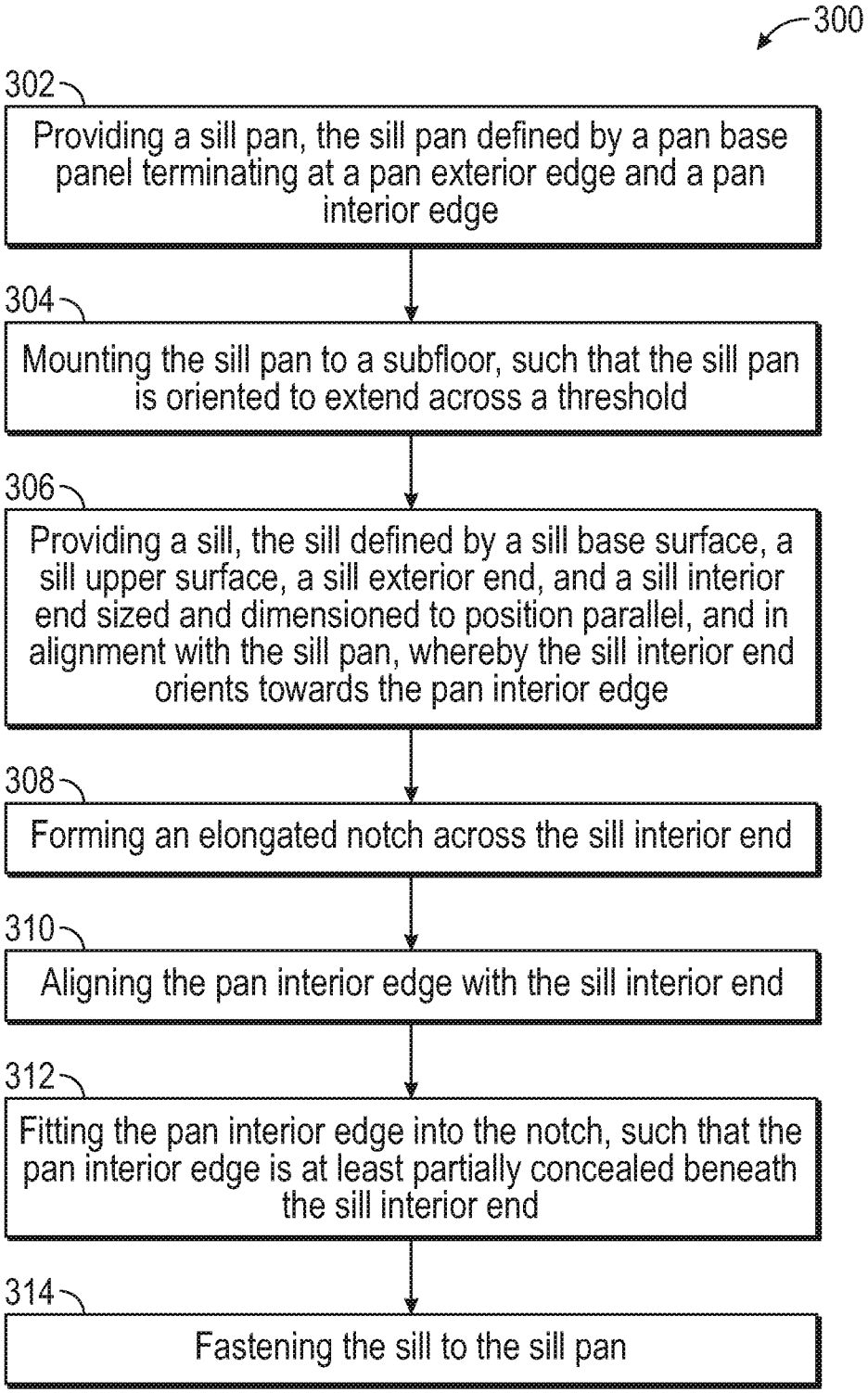
FIG. 3 illustrates a flowchart of an exemplary method for concealing a sill pan edge across a threshold, in accordance with an embodiment of the present invention.

FIG. 3 references a flowchart for a method 300 of concealing the interior edge of the sill pan. In one possible embodiment, the method 300 includes an initial Step 302 of providing a sill pan, the sill pan defined by a pan base panel terminating at a pan exterior edge and a pan interior edge. The edges 110, 112 of the sill pan 106 extend out to help seal the threshold. However, this can often create an unsightly threshold.

In some embodiments, the method 300 further comprises a Step 304 of mounting the sill pan to a subfloor, such that the sill pan is oriented to extend across a threshold. Another Step 306 comprises providing a sill, the sill defined by a sill base surface, a sill upper surface, a sill exterior end, and a sill interior end sized and dimensioned to position parallel, and in alignment with the sill pan, whereby the sill interior end orients towards the pan interior edge. Yet another Step 308 may include forming an elongated notch across the sill interior end.

In some embodiments, a Step 310 comprises aligning the pan interior edge with the sill interior end. A Step 312 includes fitting the pan interior edge into the notch, such that the pan interior edge is at least partially concealed beneath the sill interior end. The notch inner surface 128 is close to, or in engagement with the pan interior edge 112, or the pan exterior edge 110, or both in some instances. A final Step 314 comprises fastening the sill to the sill pan. This fastening may be possible through screws, bolts, nails, adhesives, and magnets that secure the sill 114 to the sill pan 106 through fastening means known in the art.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A sill pan concealment system, the system comprising:

a sill pan defined by a pan base panel terminating at a pan exterior wall and a pan interior wall, the pan exterior wall and the pan interior wall extending perpendicularly relative to the pan base panel; and a sill defined by a continuous sill base surface that forms a sill upper surface, the sill base surface disposed parallel and resting flush on the pan base panel, the sill further being defined by a sill exterior end and a sill interior end, the sill exterior end being oriented towards the pan exterior wall, the sill interior end being oriented towards the pan interior wall, the sill interior end forming a notch, the notch defined by a notch inner surface, the notch being sized and dimensioned to receive the pan interior wall of the sill pan, such that the notch inner surface and the pan interior wall at least partially engage, whereby the pan interior wall is at least partially concealed in the notch.

2. The system of claim 1, wherein the pan exterior wall and the pan interior wall orient in opposite directions.

3. The system of claim 1, wherein the sill upper surface is tapered.

4. The system of claim 1, wherein the pan base panel of the sill pan rests flush against a subfloor.

5. The system of claim 1, wherein the sill pan and the sill are disposed across a threshold, the threshold separating an exterior region and an interior region.

6. The system of claim 5, wherein the sill exterior end is oriented towards the exterior region.

7. The system of claim 6, wherein the sill interior end is oriented towards the interior region.

8. The system of claim 7, wherein the notch faces towards the interior region.

9. The system of claim 8, wherein the notch is vertically oriented in relation to a door.

10. The system of claim 1, wherein the notch forms through a cross section of the sill interior end.

11. The system of claim 1, wherein the notch is elongated.

12. The system of claim 1, wherein the notch is at least ¼" wide.

13. A sill pan concealment system, the system consisting of:

a sill pan defined by a pan base panel terminating at a pan exterior wall and a pan interior wall, the pan exterior wall and the pan interior wall extending perpendicularly relative to the pan base panel, the pan exterior wall and the pan interior wall orienting in opposite directions; and a sill defined by a tapered sill upper surface and an opposite continuous sill base surface, the sill base surface disposed parallel and resting flush on the pan base panel, the sill further being defined by a sill exterior end and a sill interior end, the sill exterior end being oriented towards the pan exterior wall, the sill interior end being oriented towards the pan interior wall, the sill interior end forming an elongated notch, the elongated notch defined by a notch inner surface, the elongated notch being sized and dimensioned to receive the pan interior wall of the sill pan, such that the notch inner surface and the pan interior wall at least partially engage, whereby the pan interior wall is at least partially concealed in the notch, whereby the sill pan and the sill are disposed across a threshold, the threshold separating an exterior region and an interior region.

14. The system of claim 13, wherein the sill exterior end is oriented towards the exterior region.

15. The system of claim 14, wherein the sill interior end is oriented towards the interior region.

16. The system of claim 15, wherein the notch faces towards the interior region.

17. The system of claim 13, wherein the notch forms through a cross section of the sill interior end.

18. The system of claim 13, wherein the notch is at least ¼" wide.

19. The system of claim 13, wherein the notch is vertically oriented in relation to a door.

* * * * *